US011054216B1

(12) United States Patent
Rogers et al.

(10) Patent No.: US 11,054,216 B1
(45) Date of Patent: Jul. 6, 2021

(54) BELT MOUNT FOR HOLSTER

(71) Applicant: Safariland, LLC, Jacksonville, FL (US)

(72) Inventors: William H. Rogers, St. Augustine, FL (US); Gary Grochowski, Middleburg, FL (US)

(73) Assignee: Safariland, LLC, Jacksonville, FL (US)

( * ) Notice: Subject to any disclaimer, the term of this patent is extended or adjusted under 35 U.S.C. 154(b) by 0 days.

(21) Appl. No.: 16/870,392

(22) Filed: May 8, 2020

(51) Int. Cl.
*F41C 33/04* (2006.01)

(52) U.S. Cl.
CPC ..... *F41C 33/041* (2013.01); *F41C 33/048* (2013.01)

(58) Field of Classification Search
CPC .... F41C 33/043; F41C 33/045; F41C 33/046; F41C 33/048; F41C 33/041; F41C 33/02
See application file for complete search history.

(56) References Cited

U.S. PATENT DOCUMENTS 3,894,667 A * 7/1975 Baldocchi ..... F41C 33/045 224/666
6,588,640 B1 7/2003 Rogers et al.
7,314,152 B1 * 1/2008 Garrett ..... F41C 33/0236 224/192
7,866,515 B1 * 1/2011 Buis, III ..... F41C 33/043 224/197
8,297,562 B1 * 10/2012 Yeates ..... A45F 5/02 248/118.3
D850,785 S * 6/2019 Rudd ..... D3/222
2015/0157118 A1 * 6/2015 Tseng ..... F41C 33/041 403/322.4
2018/0010885 A1 * 1/2018 Tedder ..... F41C 33/041
2018/0100720 A1 * 4/2018 Tedder ..... F41C 33/041

* cited by examiner

*Primary Examiner* — Corey N Skurdal
(74) *Attorney, Agent, or Firm* — Kane Kessler, P.C.; Paul E. Szabo

(57) ABSTRACT

A two piece holster support for supporting a handgun holster on a belt includes a first piece that is configured to clamp onto the belt at a clamp location when the belt is threaded through the first piece in a belt direction and pulled tight, thereby to support the first piece on the belt. A second piece is supported on the first piece for sliding movement relative to the first piece in the belt direction between a plurality of positions at varying distances from the clamp location. The second piece has a loop configuration defining a belt passage for engaging the belt at a location spaced apart form the base and thereby supporting the second piece on the belt. The second piece is movable on the first piece in the belt direction whereby the belt passage on the movable piece can be set at a variable distance from the clamp location of the base.

20 Claims, 10 Drawing Sheets

BELT MOUNT FOR HOLSTER

BACKGROUND OF THE INVENTION

This invention relates to a holster support for a handgun holster. The holster support is of the type that is supported on the belt of a wearer's trousers, and thus is sometimes called a "belt mount" for a holster. The belt mount in turn supports the holster, which supports the handgun.

There are numerous existing designs for such belt mounts. The most prevalent design uses one or several loops, or two slots. The wearer's belt can pass through the loops or weave through the slots to secure the belt mount and thus the holster to the wearer's body. Because the wearer's belt must also pass through a series of fixed belt loops attached to the wearer's trousers, in order to support the trousers, this type of belt mount often has a relatively short length as measured in the belt direction (along the length of the belt, between back and front), so that it can fit between two adjacent trouser belt loops.

A belt mount that has only a single narrow loop to support it on the belt is not desirable because the holster can easily rock forward and rearward. In addition, the belt mount is more likely to slide along the wearer's belt. Increasing the length of the belt mount improves stability, but the belt mount can then interfere with the fixed belt loops on the wearer's trousers; the wearer is forced to place the holster in front of or behind the fixed trouser belt loop, or to tailor the trousers by moving the trouser belt loop. Placing the belt mount in a position overlying a trouser belt loop can undesirably push the mount and holster outward away from the hip, thus decreasing concealability. In addition, the most popular location to mount a handgun holster is at the side of the body, adjacent to the hip. Unfortunately, most trousers have a fixed belt loop at that location.

SUMMARY OF THE INVENTION

This invention pertains to a belt mount for a handgun holster. The belt mount offers close concealment of the handgun while providing additional stability and adjustment to the body placement of the holster. The belt mount has two parts, a base and a sliding loop. The loop is able to slide on a thin flexible arm that projects from a main body portion of the base. The flexible arm is able to bend to conform to the wearer's waist, as is the base also. The movable loop is small enough so that it can pass through a trouser belt loop, or adjust so that it is in close proximity to the trouser belt loop without interference. The base has an opposing fixed slot which is part of the base. The sliding loop and the fixed slot are separated by a minimum distance which can be extended approximately two inches outward. The ambidextrous configuration of the belt mount allows the wearer to affix the belt mount on either side of the body, and also to place the movable loop toward either the front of the body or the back depending on individual preference. The wearer's belt passes through the fixed loop on the base, and through the movable loop also, thus securing the belt mount and the holster to the wearer's body. The attachment points for the holster on the belt mount are slotted, to allow the holster to have an adjustable cant on the wearer's body.

In one embodiment, the invention is a two piece holster support for supporting a handgun holster on a belt, the holster support comprising a first piece that is configured to clamp onto the belt at a clamp location when the belt is threaded through the first piece in a belt direction and pulled tight, thereby to support the first piece on the belt; and second piece that is supported on the first piece for sliding movement relative to the first piece in the belt direction between a plurality of positions at varying distances from the clamp location. The second piece has a loop configuration defining a belt passage for engaging the belt at a location spaced apart form the base and thereby supporting the second piece on the belt. The second piece is movable on the first piece in the belt direction whereby the belt passage on the movable piece can be set at a variable distance from the clamp location of the base.

In another embodiment, the invention is a holster support for supporting a handgun holster on a belt, the holster support comprising a base having a main body portion with two openings separated by a bar, the base being configured to receive a belt threaded in a belt direction through the two openings and across the bar, thereby to support the base on the belt. The base has material portions configured for supporting a holster on the base. The base includes an arm that projects from the main body portion of the base in the belt direction. The holster support also comprises a movable loop supported on the arm of the base for sliding movement relative to the arm in the belt direction, the movable loop having portions defining a belt passage in the movable loop for threadedly receiving the belt therethrough, thereby to support the movable loop on the belt.

BRIEF DESCRIPTION OF THE DRAWINGS

Further features of the invention will become apparent to one of ordinary skill in the art to which the invention pertains, from a reading of the following description of one embodiment together with the accompanying drawings, in which.

DESCRIPTION OF AN EMBODIMENT OF THE INVENTION

Figure 1:
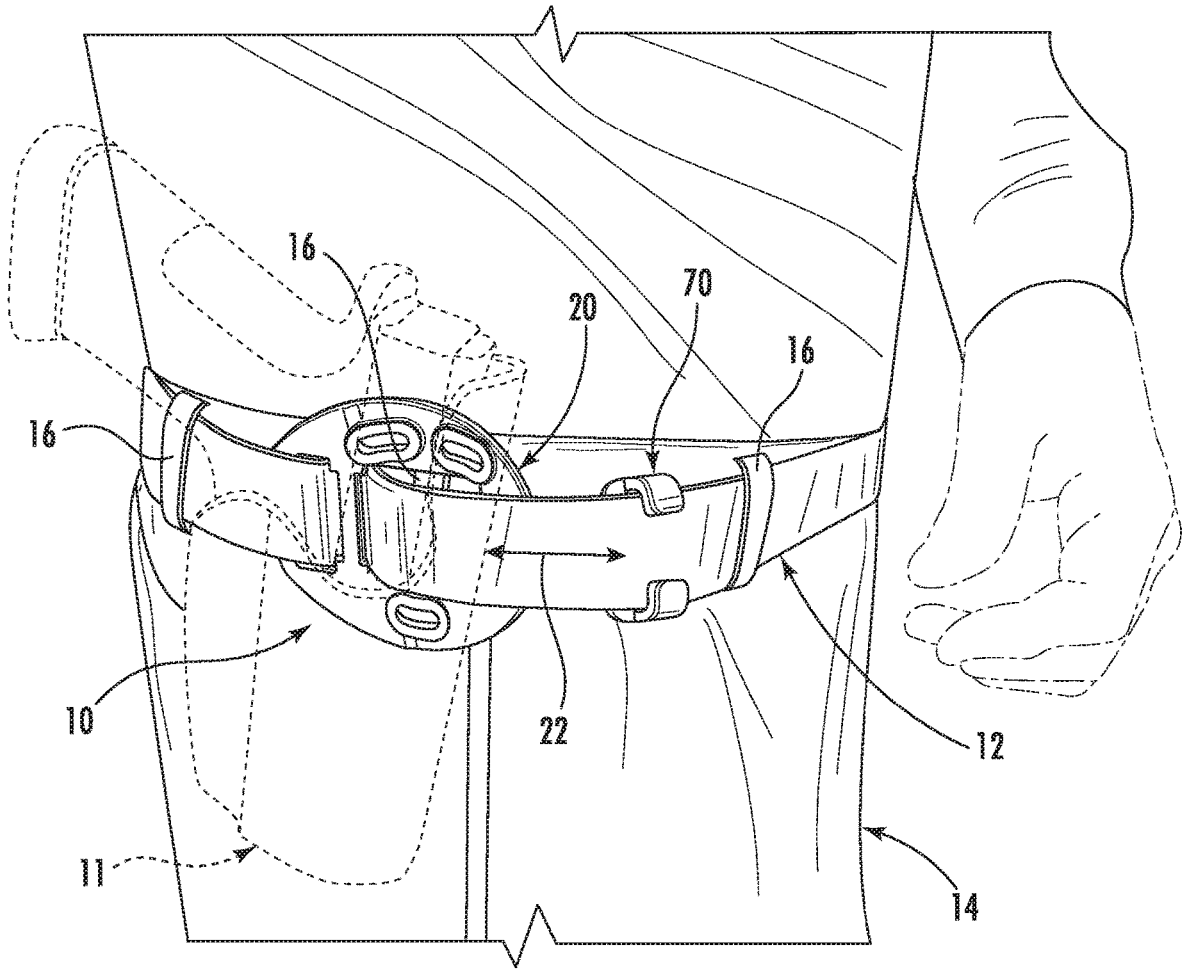
FIG. 1 is a pictorial illustration of a portion of a wearer's trousers with one or more belt loops and being supported by the wearer's belt, with the belt supporting a belt mount that is a first embodiment of the invention, the belt mount in turn supporting a holster and a handgun in the holster.
Figure 2:
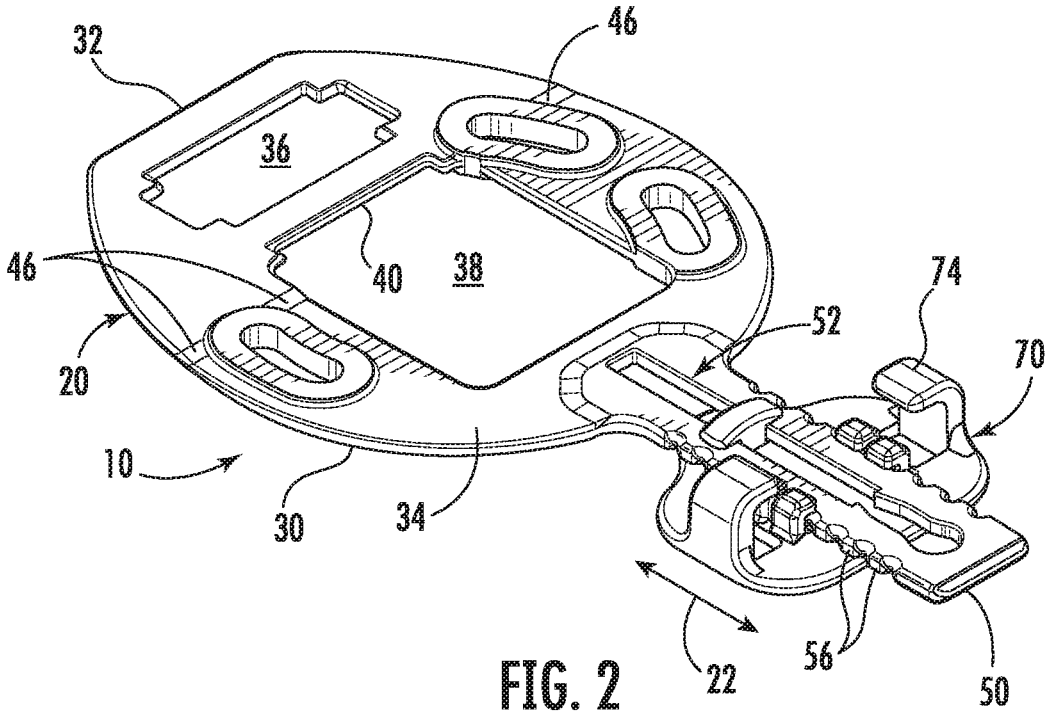
FIG. 2 is a perspective assembly view of the belt mount of FIG. 1.
Figure 3:
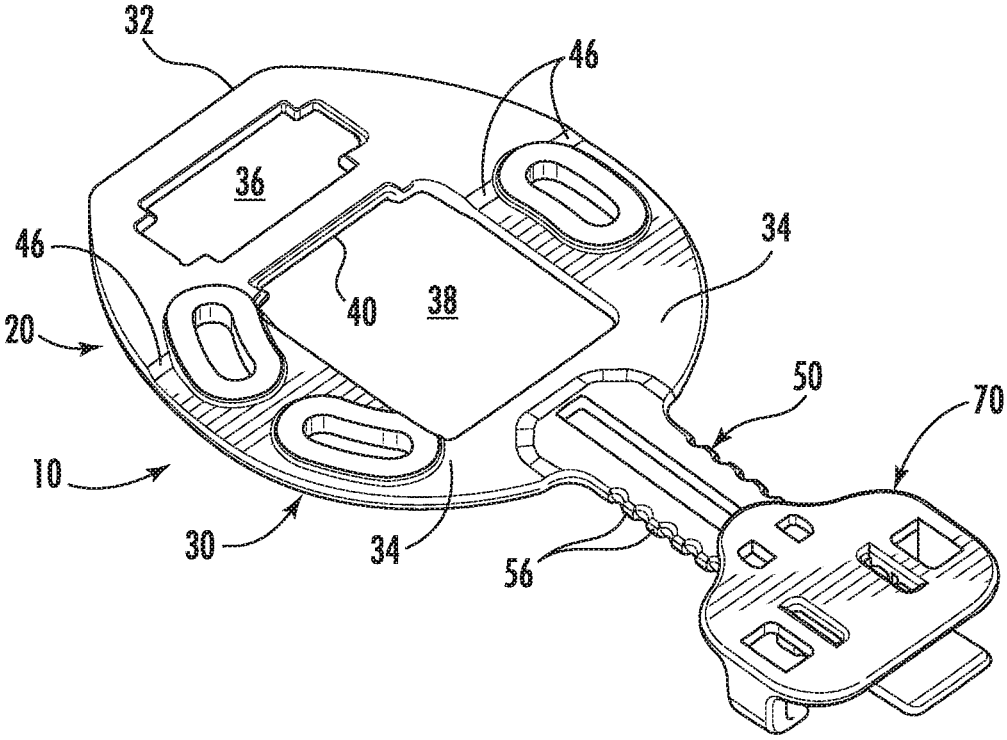
FIG. 3 is another perspective assembly view of the belt mount of FIG. 2.
Figure 4:
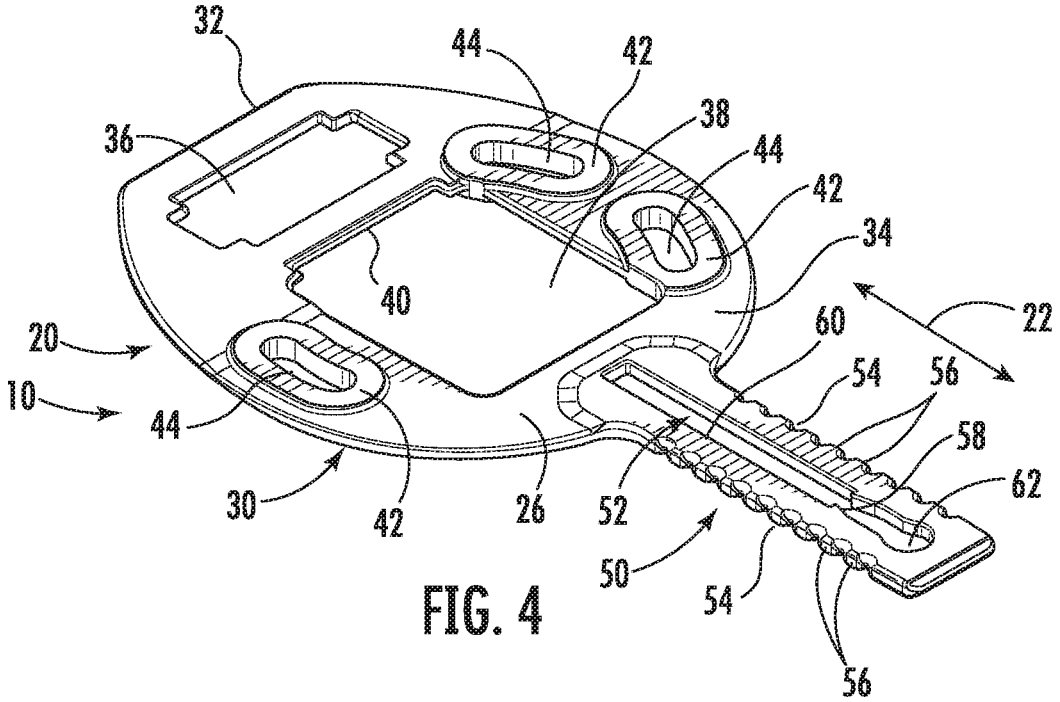
FIG. 4 is a perspective view of a base that is a first part of the belt mount of FIG. 2.

The present invention relates to a belt mount for a handgun holster. The invention is applicable to belt mounts of different and varying configurations. As representative of the invention, the drawings illustrate a holster support or belt mount 10 that is one embodiment of the invention. Other embodiments are possible.

The belt mount 10 is configured to support a holster 11 on a belt 12 of a wearer's trousers 14. The trousers have a number of trouser belt loops 16 at the waistband, so that the belt can support the trousers on the wearer. The belt 12 is typically one inch wide to one and a half inches tall (wide). The thickness of the belt 12 is typically in the range of from ⅛" to ¼".

The belt mount 10 in the illustrated embodiment is an assembly of two parts, a base 20 and a movable loop 70. The movable loop is supported on the base 20, in a manner described below, for movement relative to the base so as to vary the length of the belt mount 10. This length is measured in a direction along the length of the belt 12, between front and back along the wearer's waist and hips, and referred to as the "'belt direction 22".

The base 20 is preferably molded as one piece from a plastic material, such as Nylon. The base 20 is generally planar in configuration with a thickness that extends between first and second opposite major side surfaces 26 and 28. The base 20 may be about the same thickness as the belt 12 with which it is used, or somewhat thinner. The base dimensions including the thickness of the base 20 are described below in more detail.

The base 20 includes generally two main portions—a main body portion 30, and an arm portion or arm 50 that extends from the main body portion 30. In the illustrated embodiment, the main body portion 30 is oval in configuration, slightly longer in the belt direction 22. The main body portion 30 has first and second opposite end portions 32 and 34. The arm 50 extends from the second end portion 34 of the base 20.

Figure 5:
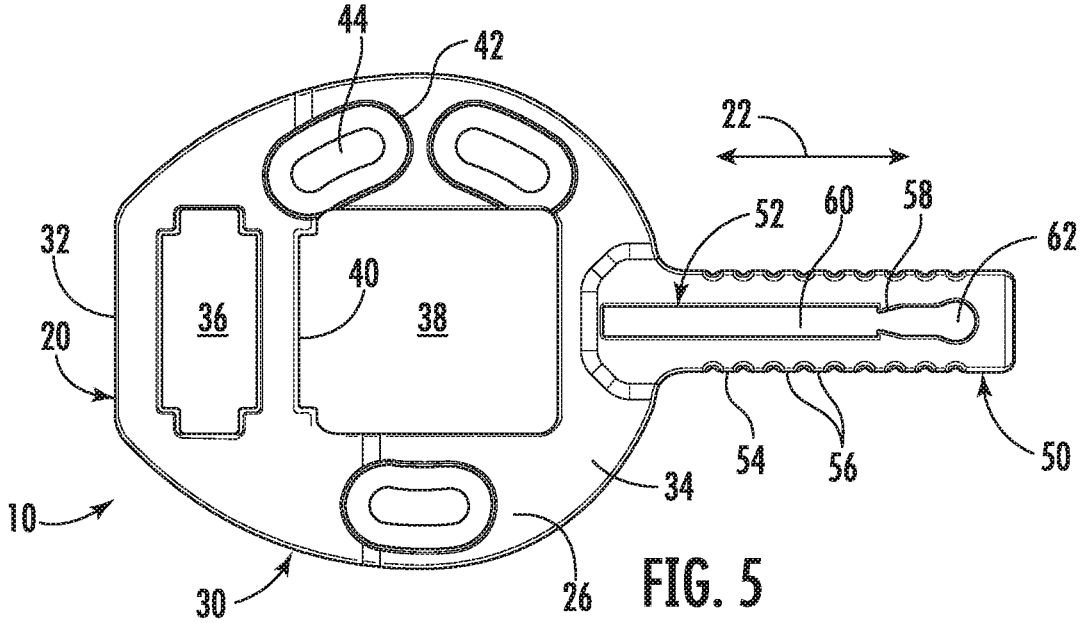
FIG. 5 is a plan view of the base of FIG. 4.
Figure 6:
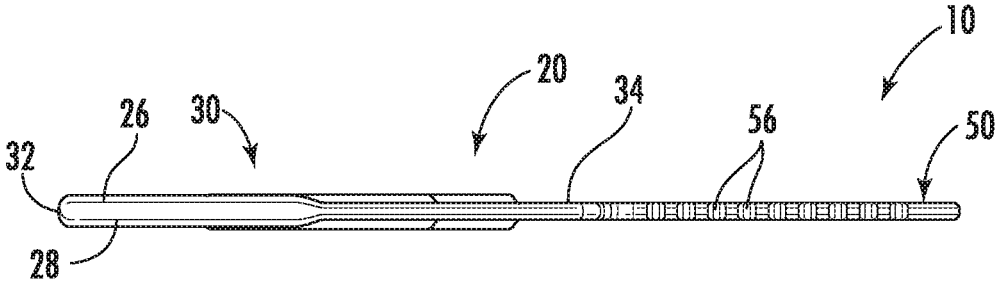
FIG. 6 is a side elevational view of the base of FIG. 4.
Figure 7:
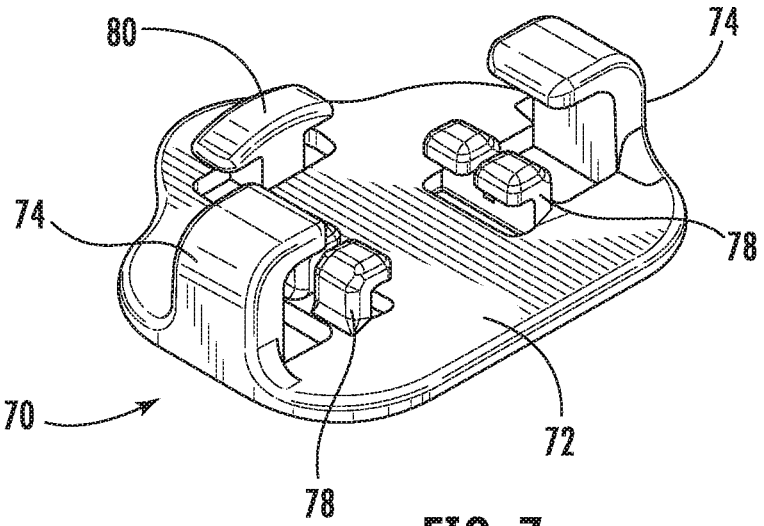
FIG. 7 is a perspective view of a movable loop that is a second part of the belt mount of FIG. 2.
Figure 8:
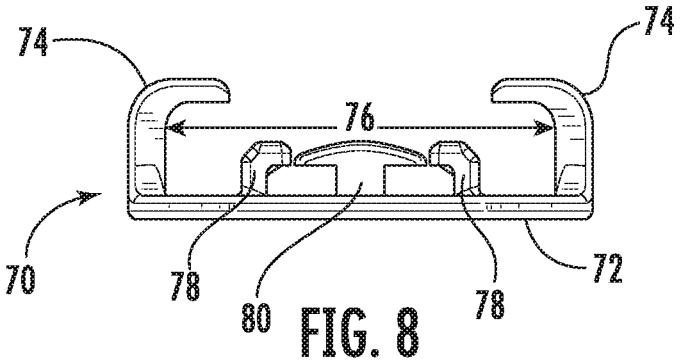
FIG. 8 is an end elevational view of the movable loop of FIG. 7.
Figure 9:
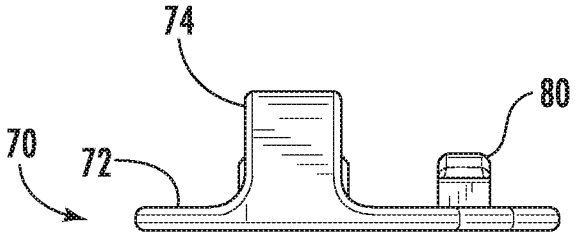
FIG. 9 is a side elevational view of the base of FIG. 7.

The main body portion 30 of the base 20 has two large openings 36 and 38 that extend through the material thickness of the main body portion 30, between the opposite major side surfaces 26 and 28. The openings 36 and 38 allow for passage (threading) of the belt 12 through the base 20. The base 20 is large enough in height (a vertical direction as viewed in FIG. 5) and in length to encompass these openings 36 and 38, and not much larger.

The first opening 36 is located adjacent to the first end portion 32 of the base 20 and is generally rectangular in configuration. The height of the first opening 36 (in a direction from top to bottom as viewed in FIG. 5, transverse to the belt direction 22) is selected to enable the passage therethrough of a typical wearer belt 12. In the illustrated embodiment, the first opening 36 at its tallest is one and a half inches to accommodate and grip a wider (one and a half inches) belt. Four inward protrusions 37 at the corners of the first opening 36 result in narrower ends of the first opening 36, designed to accommodate and grip a narrower (one inch) belt 12.

The second opening 38 in the main body portion 30 is adjacent to the second end portion 34, and is thus nearer to the arm 50. The second opening 38 is aligned in the belt direction 22 with the first opening 36. The second opening 38 is generally rectangular in configuration. The height of the second opening 38 is selected to enable the passage therethrough of a typical wearer belt 12. In the illustrated embodiment, the second opening 38 has a maximum height of one and a half inches. Two protrusions 39 at the corners of the second opening 36 that are nearer to the first opening 36 result in that end of the second opening 38 being narrower.

Separating the first and second openings 36 and 38 is a bar 40. The bar 40 extends across the height of the base 20. The first opening 36 is bounded lengthwise by the bar 40 and the first end portion 32 of the base 20. The second opening 38 is bounded lengthwise by the bar 40 and the second end portion 34 of the base 20.

The main body portion 30 of the base 20 also has material portions 42 defining one or more fastener openings 44 for receiving fasteners for the holster 11. In the illustrated embodiment the material portions define three fastener openings 44, two of them being arcuate shaped on one side of the second opening 38, and the remaining one being oval shaped on the opposite side of the second opening 38. The location and configuration of these openings 44 will fit a known holster 11 with three fasteners to enable cant adjustment of the holster on the belt mount 10. Other ways of supporting the holster on the belt mount are possible, of course.

In one embodiment that was manufactured, the following dimensions of the base were determined to provide an optimum amount of flexibility while still retaining the desired amount of strength and support. The first end portion 32 of the base 20 was about 0.11375" in thickness. The base thickness tapered down at ramps 46 by about 0.02" in a direction toward the second end portion 34. The second end portion 34 was about 0.09375" in thickness. The material portions 42 around the fastener openings 44 were about 0.160" in thickness. The arm 50 was about 0.11375" in thickness.

The arm, or arm portion, 50 of the base 20 projects (extends) away from the second end portion 34 of the main body portion 30 of the base, in a direction away from the first end portion 32—thus, in the belt direction 22. The arm 50 is flexible along its length. The arm 50 may be slightly thinner or thicker in cross section than the main body portion 30 of the base 20. As a result, the arm 50 may be more or less flexible than the main body portion 30, because it is of varied thickness and also is narrower in height.

The arm 50 has a generally rectangular configuration, with a slot 52 down the middle between two outer edges 54 that each have a series of locking teeth 56. Near the outer end of the slot 52 is a detent 58, dividing the slot into a longer main portion 60 and a shorter outer end portion 62.

The movable loop 70 is a piece that is separate from and removably attached to the base 20. The movable loop 70 may be formed from the same plastic material as the base 20, preferably by molding. The main part of the movable loop 70 is a base plate 72.

The base plate 72 supports two belt tabs 74 at opposite ends of the base plate. The belt tabs 74 and the base plate 72 together provide the movable loop 70 with a belt loop configuration. The belt tabs 74 define between them a belt passage 76. The height of the belt passage 76, that is, the distance between the belt tabs 74, is selected to enable the belt tabs to engage and/or capture the opposite edges of the wearer's belt 12. Thus, the belt passage 76 may have a height of about one inch to about one and a half inches. The belt tabs 74 are configured to snugly receive the belt 12, thus supporting the belt tabs and the entire movable loop 70 on the belt.

The movable loop 70 also has two locking pawls 78 that project from the base plate 72 at locations inward of the belt tabs 74. The distance between the two locking pawls 78 is selected to enable the locking pawls to engage the teeth 56 on the outer edges 54 of the arm 50 of the base 20. Finally, the movable loop 70 also has a base locking tab 80 that is located at one side edge of the base plate 72.

Because of its dimensions and the material from which the base 20 is made, both the main body portion 30 and the arm 50 are flexible. Specifically, the two end portions 32 and 34 can be bent relative to each other about the lengthwise center of the base 20. This flexibility can be seen in FIG. 16, which illustrates the belt mount 10 in use on a wearer's trousers 14. Also, the arm 50 is flexible along its length.

In one embodiment that was manufactured, the following dimensions were determined to provide an optimum amount of flexibility while still retaining the desired amount of strength and support. The first end portion 32 of the base 20 was about 0.11375" in thickness. The base thickness ramped down at ramps 46 to The material portions 42 around the fastener openings 44 were about 0.160" in thickness. The second end portion 34 was about 0.09375" in thickness. The arm 50 was about 0.11375" in thickness.

Figure 10:
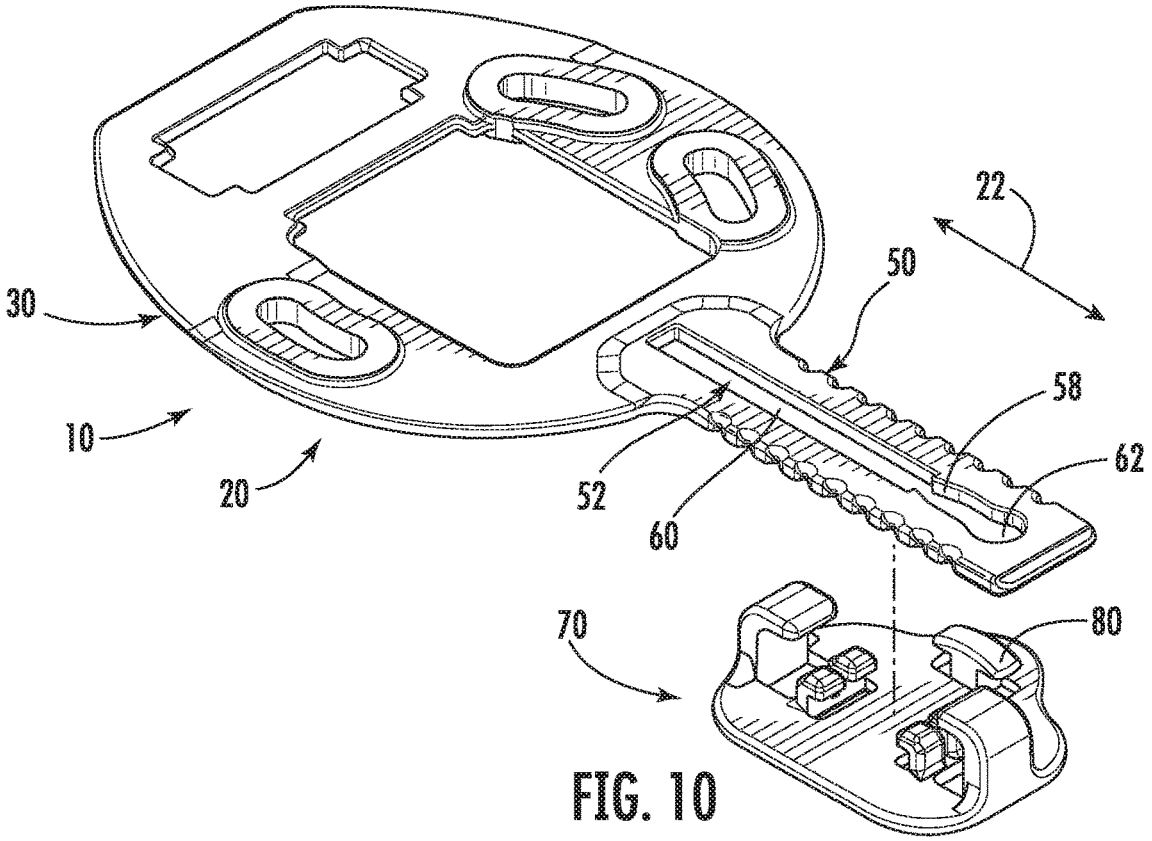
FIGS. 10 through 13 are a series of perspective views illustrating assembly of the movable loop to the base thereby to form the assembled belt mount.
Figure 11:
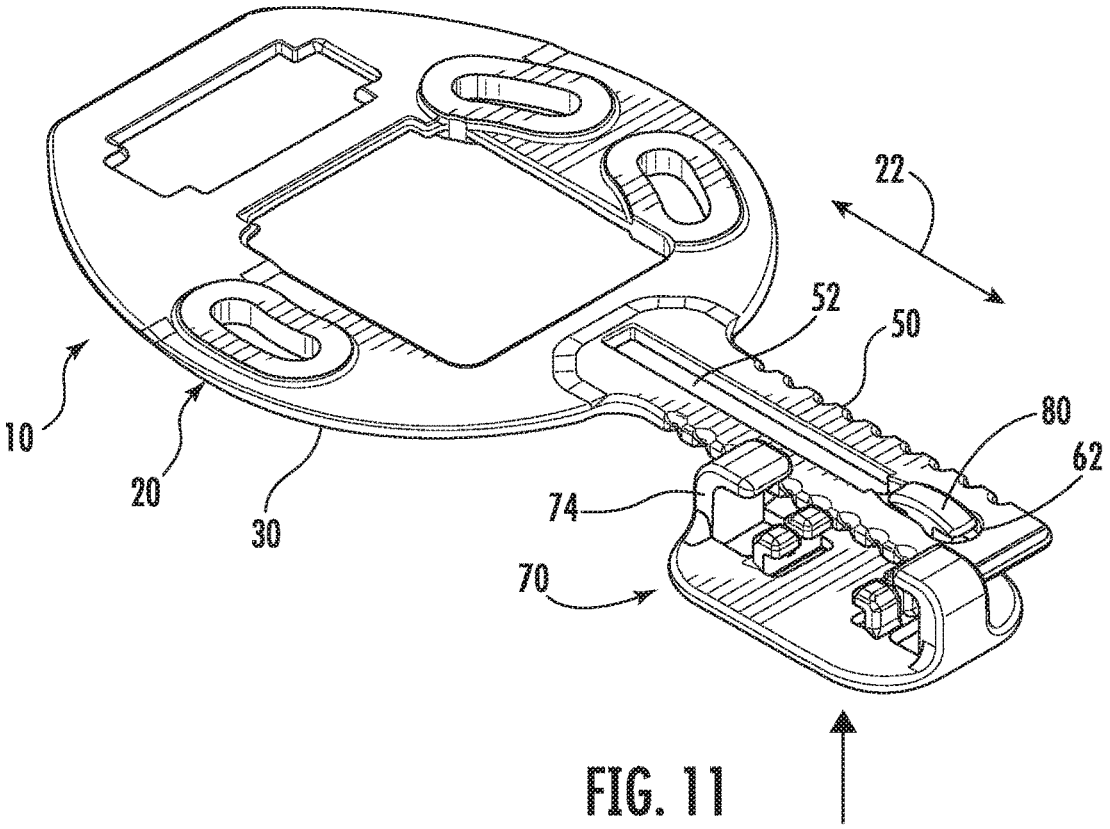
Figure 12:
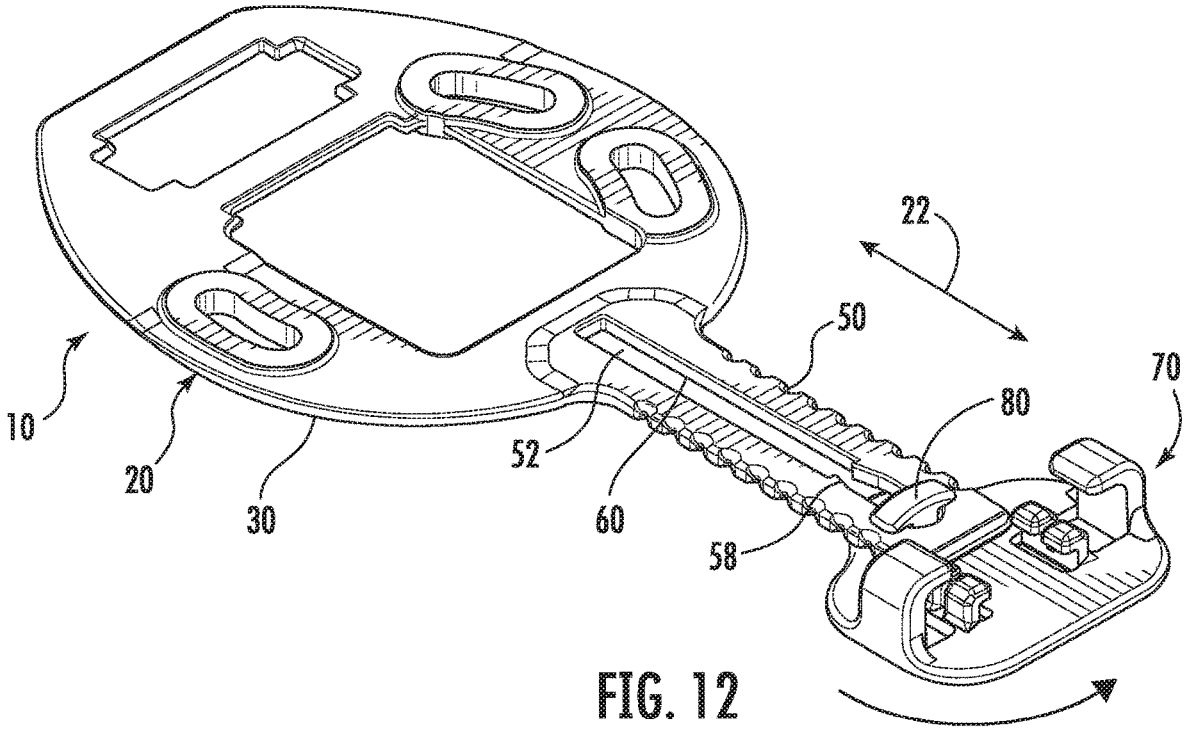

The movable loop 70 is assembled with the base 20 in a manner as shown in FIGS. 10-13. To start, the movable loop 70 is oriented so that the belt tabs 74 are in line parallel to the belt direction 22 (FIG. 10). The base locking tab 80 of the movable loop 70 is inserted into the short outer end portion 62 of the slot 52 in the arm 50 (FIG. 11). Then the movable loop 70 is turned ninety degrees relative to the base 20 (FIG. 12) and moved along the arm 50 toward the main body portion 30 of the base.

Figure 13:
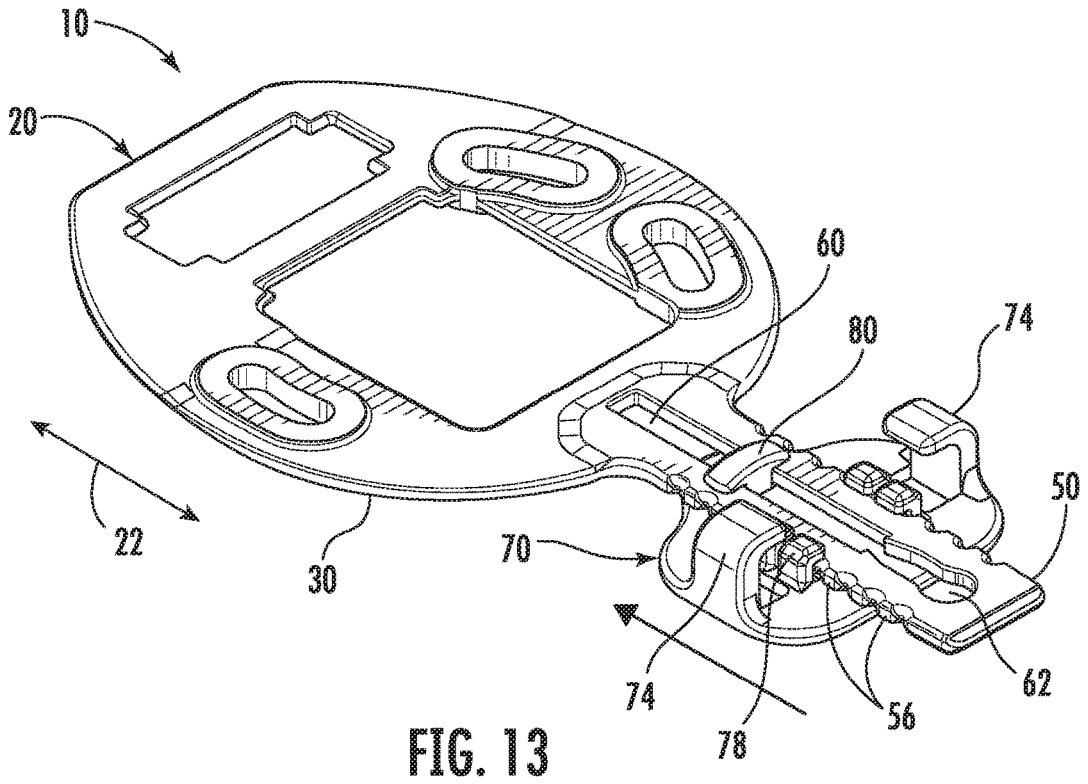
Figure 14:
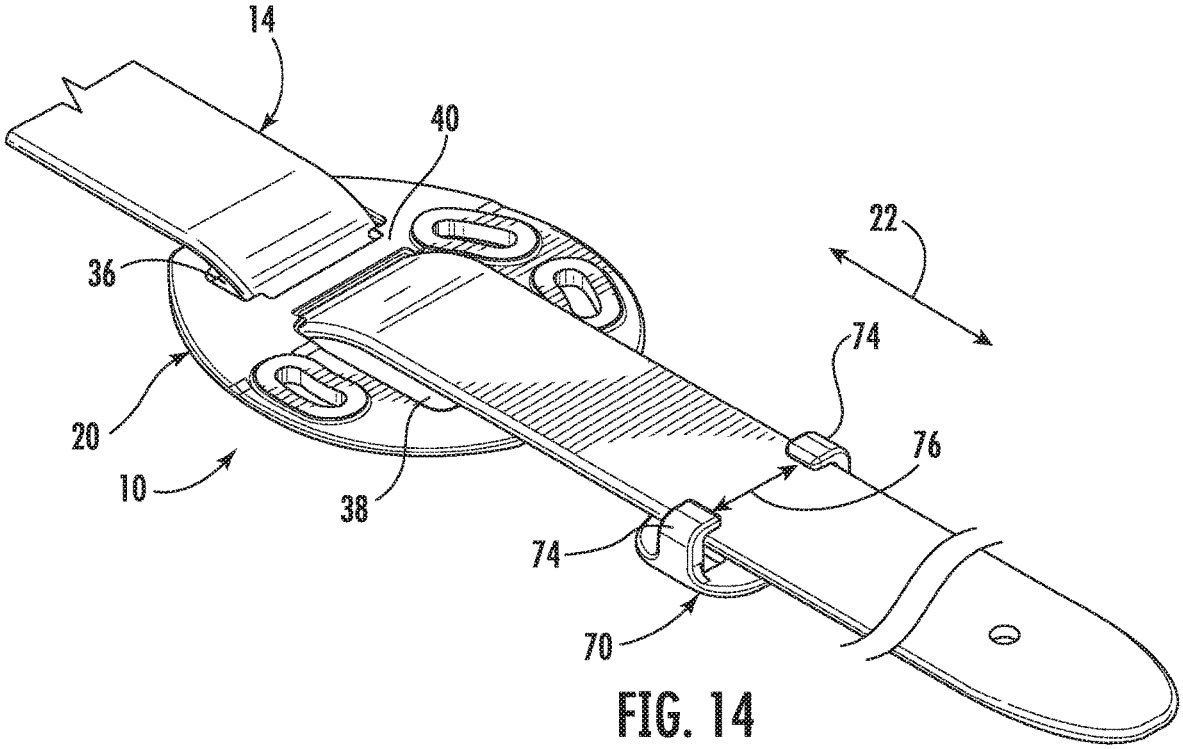
FIG. 14 is an outside perspective illustration showing a belt threaded through the belt mount.
Figure 15:
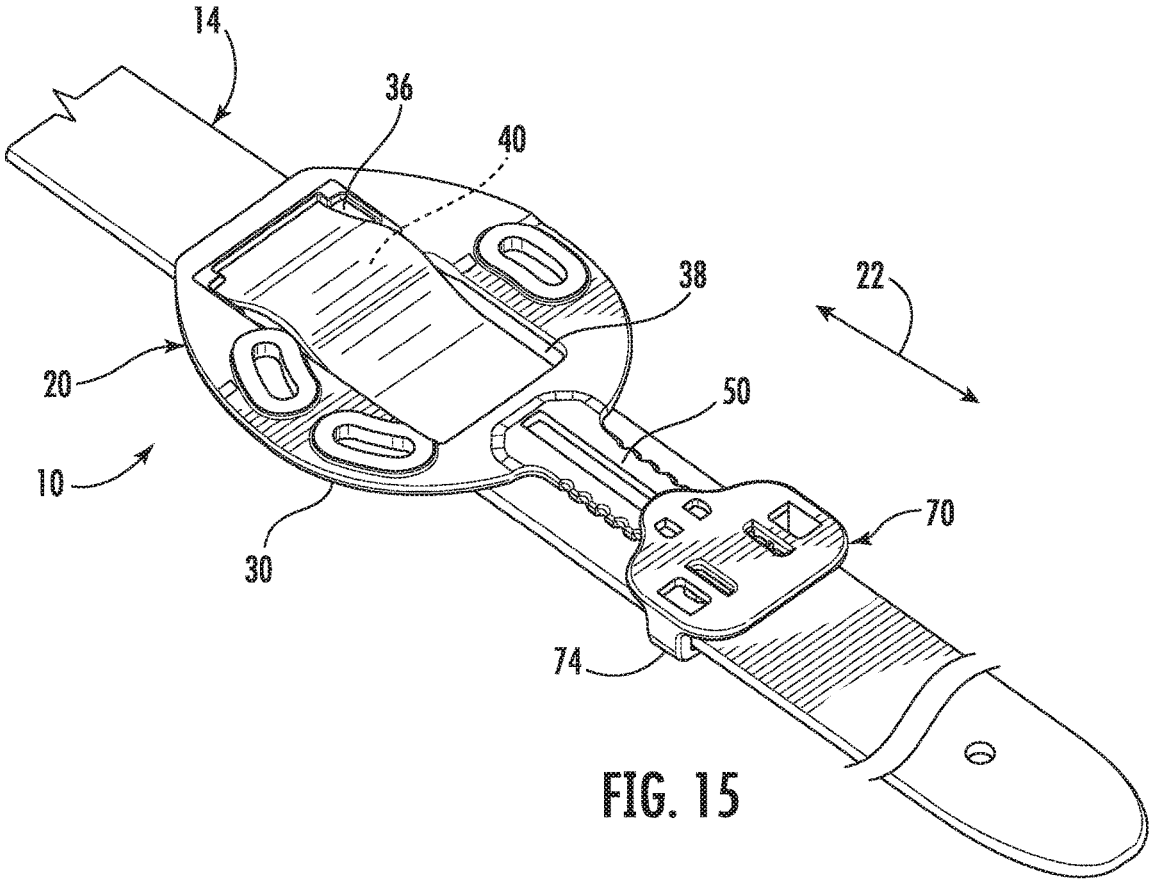
FIG. 15 is an inside perspective illustration showing a belt threaded through the belt mount.
Figure 18:
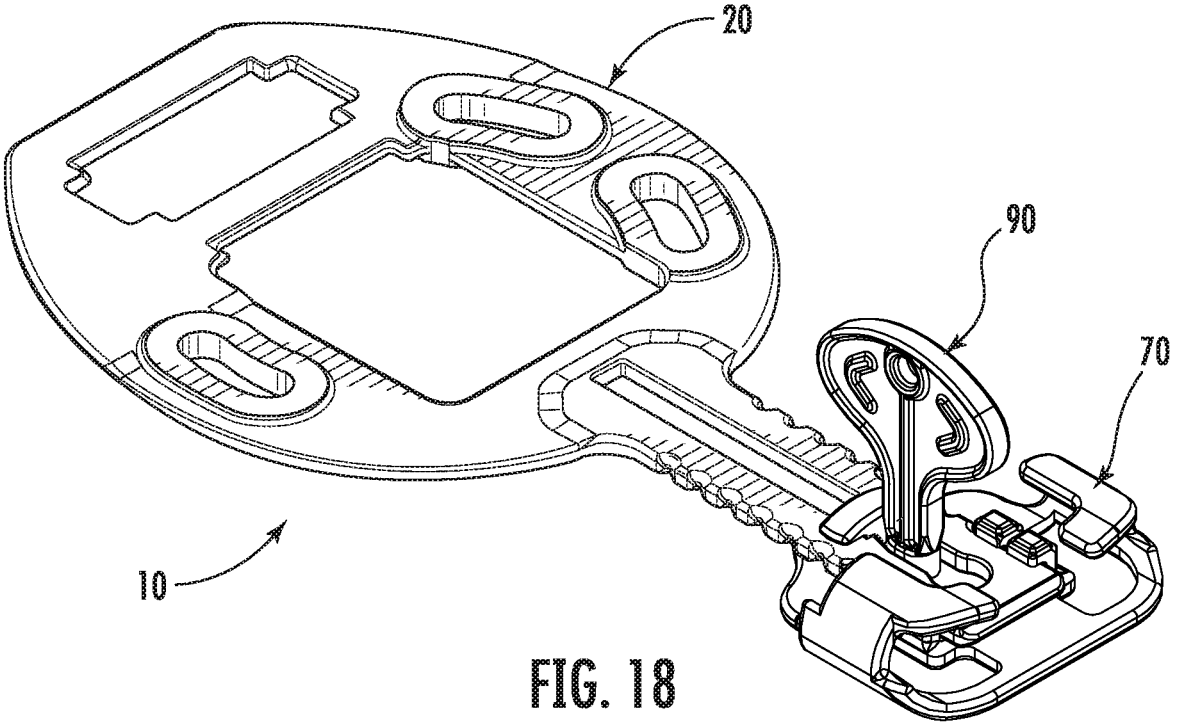
FIG. 18 illustrates the use of a release key to enable removal of the movable loop from the base.
Figure 19:
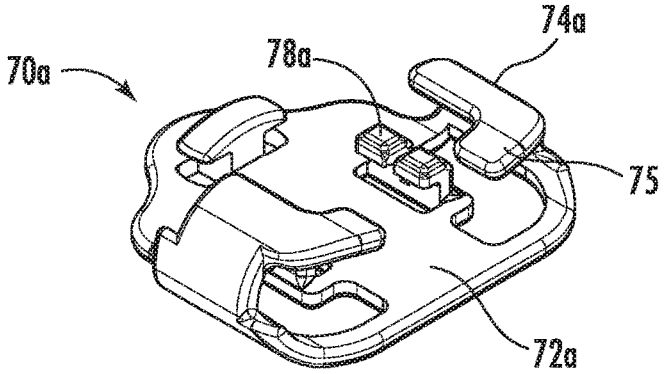
FIGS. 19-23 illustrate a movable loop that is part of a second embodiment of the invention, in use with different belt sizes.

The base locking tab 80 on the movable loop 50 moves past the detent 58 on the arm 50, and into the main portion 60 of the slot 52 (FIG. 13). The configuration of the parts 20 and 70 is such that the base lock tab 80 cannot easily be removed from the main portion 60 of the slot 52, which removal would allow separation of the movable loop from the base. The base locking tab 80 can be removed from the slot 52 only when it is in the short outer end portion 62 of the slot 52 and after relative rotation of the parts. The detent 58 resists movement of the base lock tab 80 into the short outer end portion 62 of the slot 52, thereby keeping the parts 20 and 70 assembled, unless forced in a manner not encountered in normal usage. Alternatively, a release key 90 (FIG. 18) can be provided to temporarily spread apart the sides of the arm 50 to enable release.

As a result, the movable loop 70 is securely attached to the base 20 during use of the belt mount 10. At the same time, the movable loop 70 is manually movable along the length of the arm 50, with the locking pawls 78 on the movable loop releasably engaging the teeth 56 on the edges 54 of the arm 50. This engagement of the pawls 78 with the teeth 56 releasably holds the movable loop 70 in position on the base 20, at the location selected by the wearer.

The belt mount 10 can be used in several different manners. One such manner is illustrated in FIGS. 1 and 14-17.

The end of the wearer's belt 12 opposite the buckle (the tongue of the belt) is threaded in the belt direction 22 through the first opening 36 in the main body portion 30 of the base 20. The belt 12 is looped over the bar 40, and down into the second opening 38. The belt 12 is then extended under the second end portion 34 of the main body portion 30 of the base 20. The belt 12 passes under the arm 50 and is threaded through the outwardly facing belt passage 76 in the movable loop 70. The tongue end of the belt 12 can then be joined to the belt buckle in a normal manner.

When the belt 12 is pulled tight, the belt is effectively clamped in the main body portion 30 of the base 20 because the belt is wrapped around, sequentially, the first end portion 32 of the base 20, the bar 40, and the second end portion 34 of the base. The base 20 thus forms what is effectively a "belt loop" that both supports the base of the belt mount 10 (the first piece of the belt mount) vertically on the belt 12, and also clamps the base horizontally on the belt.

The belt 12 is also engaged in the belt passage 76 in the movable loop 70. This engagement forms what is effectively a second "belt loop" that securely supports the movable loop 70 of the belt mount 10 (the second piece of the belt mount) on the belt 12. The belt mount 10 is thereby securely mounted on the belt 12 at two locations—the bar 40, and the movable loop 70 (the belt passage 76).

As discussed above, the length of the belt mount 10 is adjustable by the wearer. The position of the movable loop 70 on the arm 50 can be selected to fit the wearer, to best position the belt mount 10 relative to the position of the trouser belt loops 14. The movable loop 70 can be slid along the arm 50 of the base 20, so that the assembly 10 is as long as possible for maximum support while still fitting around the existing trouser belt loops 14. The engagement of the locking pawls 78 on the movable loop 70, with the locking teeth 56 on the arm 50, holds the movable loop 70 in the selected position on the base 20.

The bar 40 of the base 20, and the belt passage 76 of the movable loop 70, are spaced apart from each other by a significant distance in the belt direction 22. This distance is selectively variable by the wearer. In one embodiment, the movable loop 70 can be positioned up to four and a half inches from the bar 40. This variable and extended spacing provides a secure support of the belt mount 10 and the holster 11 on the belt 12, while at the same time minimizing any tendency to cant (rock forward and aft).

Figure 16:
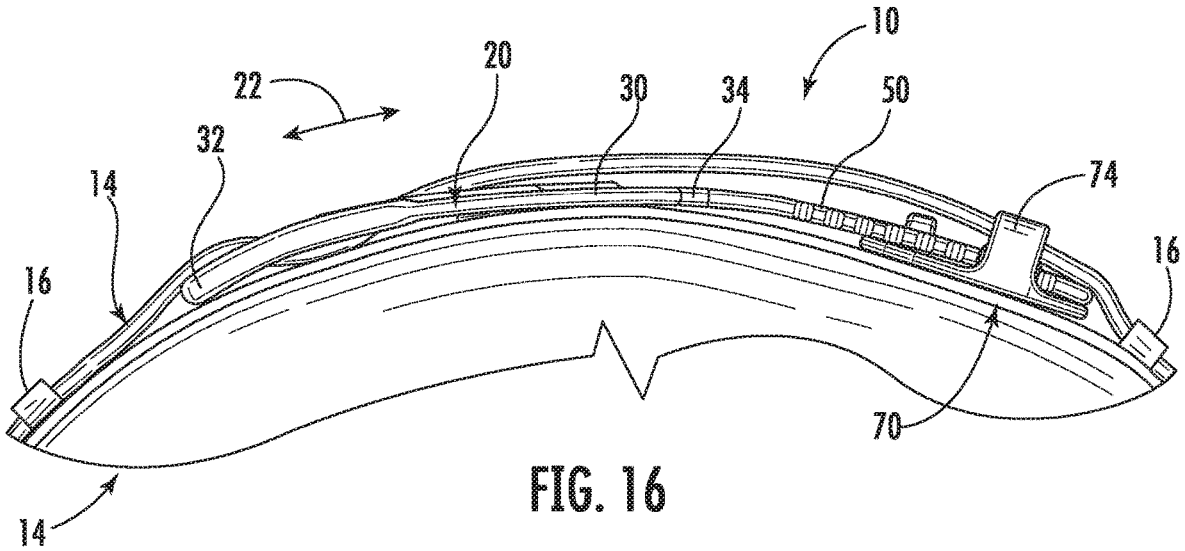
FIG. 16 is a side pictorial illustration showing the belt mount, belt, and waistband portion of trousers.
Figure 17:
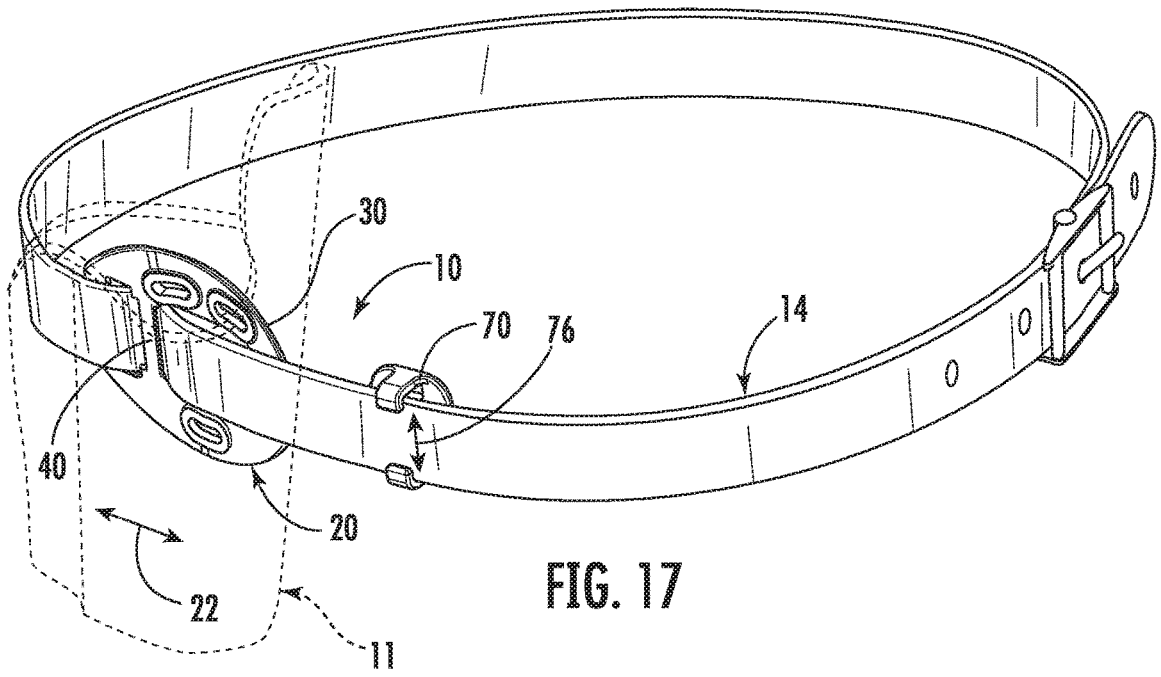
FIG. 17 illustrates the belt mount in use on belt.

In addition, the position of the belt mount 10 on the belt 12 can be adjusted to accommodate an underlying trouser belt loop. The second opening 38 in the base 20 acts as a window or recess to enable a trouser belt loop 16 to fit at least partially within the overall volume (thickness) of the base 20. This feature is shown in FIG. 16. As a result, the belt mount 10 can be positioned closer to the user's body, to assist in concealment of the holster 11 and handgun.

The belt mount 10 can also said to be "ambidextrous". The parts 20 and 70 are mirror image the same when flipped upside down. Thus, the belt mount 10 can be used on the opposite hip with the movable loop 70 to the back. Or, the belt mount 10 can be reversed and used on the same hip, with the movable loop 70 located to the back.

Another feature of the holster support 10 is that the movable loop 70 can be configured to be small enough to pass through a trouser belt loop 16. Trouser belt loops are generally constructed to enable the use of wide (tall) belts. In one sample embodiment that was constructed, the movable loop 70 is about ½" in depth, which is small enough to pass through many sizes of trouser belt loops 14. As to other dimensions, the sample had an overall length, between the bar 40 and the movable loop 70, in a range of from about 3 inches to about 5 inches.

FIGS. 19-23 illustrate a movable loop **70*a* that is a part of a second embodiment of the invention. Like the movable loop 70, the movable loop 70*a* has belt tabs 74*a* that extend upward from a base plate 72*a* and inward toward each other. However, the belt tabs 74*a* on the movable loop 70*a* differ in a number of ways. First, the tabs 74*a* curve inward toward each other as they extend away from the base plate, to help grip the edges of the user's belt 14. Second, the tabs 74*a*** curve downward toward the base plate 72*a*, to help grip the top of the user's belt 14. Third, the tabs 74*a* are extended longitudinally in the belt direction 22, to provide more contact area for gripping the user's belt 14. Fourth, the tabs 74*a* have small fingers 75 at one end to help to grip narrower belts, for example a one inch wide belt 14. Finally, the material thickness of the belt tabs 74*a* is selected so that they are flexible and may bend to grip when a belt 14 is inserted between them in the movable loop 70*a*.

Figure 20:
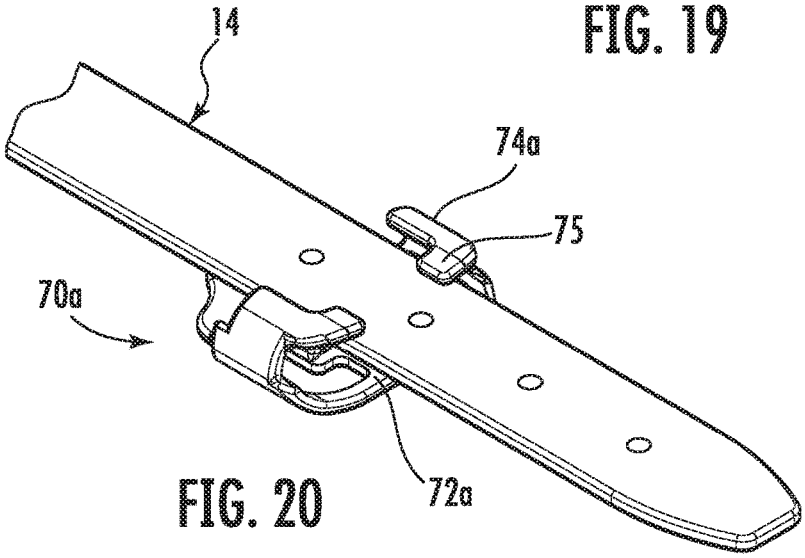
Figure 21:
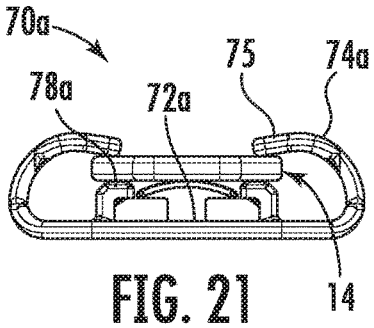
Figure 22:
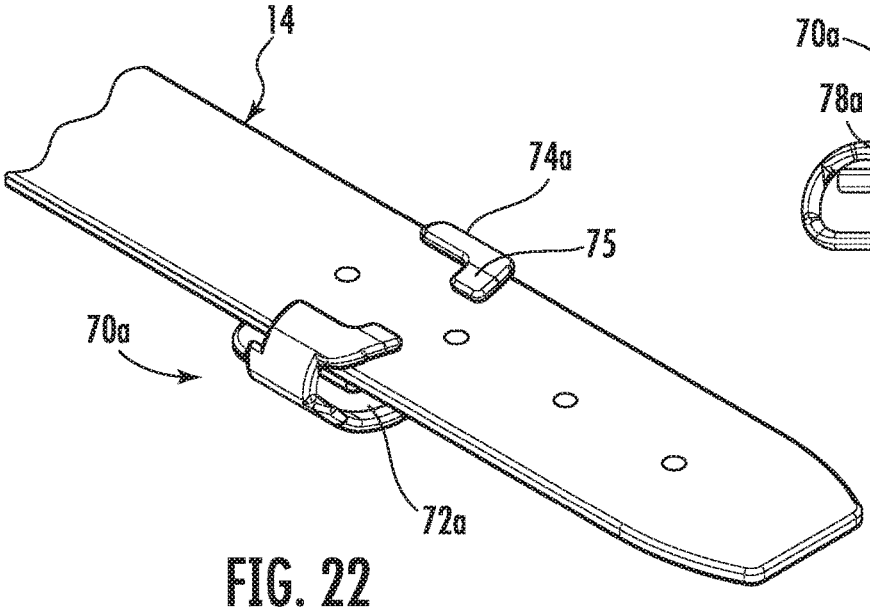
Figure 23:
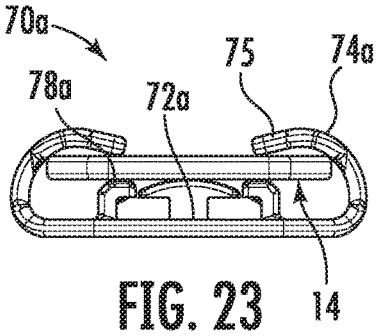

These changes make the movable loop 70*a* amenable to accommodating belts of varying widths. Specifically, FIGS. 20 and 21 shows the movable loop 70*a* in use with a narrower belt 14 having a width of for example one inch. The tab fingers 75 extend inward far enough to grip that belt. FIGS. 22 and 23 shows the movable loop 70*a* in use with a wider belt 14 having a width of for example one and a half inches. The entire belt tables 74*a* grip the outside surface of the belt 14. In each case, the belt tabs 74*a* are deflected outwards by the thickness of the belt 14 to enhance gripping.

The invention claimed is:

1. A holster support for supporting a handgun holster on a belt, the holster support comprising:

a base having a main body portion with two openings separated by a bar, the base being configured to receive a belt threaded in a belt direction through the two openings and across the bar, thereby to support the base on the belt;

the base having material portions configured for supporting a holster on the base;

the base including an arm that projects from the main body portion of the base in the belt direction; and the holster support also comprising a movable loop supported on the arm of the base for sliding movement relative to the arm in the belt direction, the movable loop having portions defining a belt passage in the movable loop for threadedly receiving the belt therethrough, thereby to support the movable loop on the belt.

2. A holster support as set forth in claim 1 wherein the arm and the movable loop have interengaging portions for holding the movable loop in a selected one of a plurality of positions along the length of the arm thereby varying the length of the holster support.

3. A holster support as set forth in claim 2 wherein the interengaging portions comprise teeth on the arm and locking pawls on the movable loop that releasably locking engage the arm teeth to set the position of the movable loop on the arm.

4. A holster support as set forth in claim 1 wherein the base is generally planar in configuration with a thickness that extends between first and second opposite major side surfaces.

5. A holster support as set forth in claim 4 wherein the base is about ⅛" thick and the overall length of the holster support is in the range of from about 3" to about 5".

6. A holster support as set forth in claim 5 wherein the movable loop is no more than about one half inch in depth to enable the movable loop to fit through a trouser belt loop.

7. A holster support as set forth in claim 1 wherein a second one of the openings in the base acts as a window or recess to enable a trouser belt loop to fit at least partially within the overall thickness of the base.

8. A holster support as set forth in claim 1 wherein the base and the arm are symmetrical so that they are the same when flipped upside down to enable the belt mount to be used on the opposite hip or with the movable loop located to the back.

9. A holster support as set forth in claim 1 further including a release key for enabling removal of the movable loop from the arm of the base.

10. A holster support as set forth in claim 1 wherein the movable loop has belt tabs that are flexed outward by the belt.

11. A holster support as set forth in claim 1 wherein the movable loop has belt tabs that are flexed outward by the belt.

12. A two piece holster support for supporting a handgun holster on a belt, the holster support comprising:

a first piece that is configured to clamp onto the belt at a clamp location when the belt is threaded through the first piece in a belt direction and pulled tight, thereby to support the first piece on the belt; and a second piece that is supported on the first piece for sliding movement relative to the first piece in the belt direction between a plurality of positions at varying distances from the clamp location;

the second piece having a loop configuration defining a belt passage for engaging the belt at a location spaced apart form the base and thereby supporting the second piece on the belt;

the second piece being movable on the first piece in the belt direction whereby the belt passage on the movable piece can be set at a variable distance from the clamp location of the base.

13. A holster support as set forth in claim 12 wherein the first piece about ⅛" thick and the overall length of the holster support is in the range of from about 3" to about 5".

14. A holster support as set forth in claim 12 wherein the first piece and the second piece have interengaging portions for holding the second piece in a selected one of a plurality of positions along the length of the first piece thereby varying the length of the holster support.

15. A holster support as set forth in claim 14 wherein the interengaging portions comprise teeth on the first piece and locking pawls on the second piece that releasably locking engage the teeth to set the position of the second piece on the first piece.

16. A holster support as set forth in claim 12 wherein the first piece is generally planar in configuration with a thickness that extends between first and second opposite major side surfaces.

17. A holster support as set forth in claim 12 wherein the second piece comprises a movable loop that is no more than about one half inch in depth to enable the movable loop to fit through a trouser belt loop.

18. A holster support as set forth in claim 12 wherein the first piece has openings that act as a window or recess to enable a trouser belt loop to fit at least partially within the overall thickness of the first piece.

19. A holster support as set forth in claim 12 wherein the first piece and the second piece are symmetrical so that they are the same when flipped upside down to enable the belt mount to be used on the opposite hip or with the second piece located to the back.

20. A holster support as set forth in claim 12 further including a release key for enabling removal of the second piece from the first piece.

* * * * *